US006003423A

United States Patent [19]

Gerard

[11] Patent Number: 6,003,423

[45] Date of Patent: Dec. 21, 1999

[54] SAW CHAIN IDENTIFICATION

[75] Inventor: Pascal A. Gerard, Milwaukie, Oreg.

[73] Assignee: Blount, Inc., Portland, Oreg.

[21] Appl. No.: 08/918,339

[22] Filed: Aug. 26, 1997

[51] Int. Cl.[6] ..... B26D 1/46

[52] U.S. Cl. ..... 83/830; 83/832; 83/522.11

[58] Field of Search ..... 83/830, 831, 832, 83/833, 834, 522.11

[56] References Cited

U.S. PATENT DOCUMENTS

| | | | |
|---|---|---|---|
| 3,020,942 | 2/1962 | Hill | 83/831 X |
| 3,204,672 | 9/1965 | Aitken | 83/834 X |
| 4,873,903 | 10/1989 | Harfst | 83/830 X |
| 5,257,568 | 11/1993 | Nitschmann | 83/830 X |
| 5,649,367 | 7/1997 | Hille et al. | 30/387 X |
| 5,666,734 | 9/1997 | Morrison | 30/837 X |

*Primary Examiner*—M. Rachuba
*Attorney, Agent, or Firm*—Robert L. Harrington

[57] ABSTRACT

A saw chain for a chain saw has an identifying code stamped into one of its links for ease of selecting replacement chain. The link with the identifying code is provided with distinguishing characteristics for ease of selecting that link. The stamped code on the link provides the specification of the saw chain required for replacement. The link may have a different shape and/or colored to distinguish that link from other similar links.

4 Claims, 2 Drawing Sheets

FIG. 6

| CODE | CHAIN ID |
|---|---|
| XXXX | XXXXXX |
| XXXX | XXXXXX |
| XXXX | XXXXXX |
| XXXX | XXXXXX |
| XXXX | XXXXXX |
| XXXX | XXXXXX |
| XXXX | XXXXXX |

SAW CHAIN IDENTIFICATION

FIELD OF THE INVENTION

This invention relates to the enablement of a chain saw user to correctly replace the existing saw chain with a similar saw chain, e.g., in type and length.

BACKGROUND OF THE INVENTION

Chain saws are fitted with a specific combination of sprocket, guide bar and saw chain and that combination varies between the many chain saws available on the market. A chain saw user who wants to replace the loop of saw chain for his chain saw has a daunting task. He has to select the specific saw chain type and length that matches his particular sprocket and guide bar. Casual users of chain saws may not require a new saw chain for many months or even years and more often than not the information provided with his chain saw at the time of purchase is lost.

Ideally the chain itself would be marked with the correct information. However, the production of a chain saw loop typically occurs in three stages. First the parts are produced. Then the parts are assembled. Finally, the assembled saw chain is formed into loops. Stamping of information occurs when the parts are produced and those parts may end up in any number of chain-part combinations. Particularly the loop length is not determined until assembly and the pre-produced parts cannot be stamped with a specific loop length without creating substantial inventory problems.

Marking a finished loop of saw chain is likely limited to processes such as painting numbers onto the chain but paint and similar marking products rapidly wear off the chain during use. Accordingly, a primary objective of this invention is to provide an identifying mark on a loop of saw chain that can be readily discerned without causing undue manufacturing complexities and costs, and does not wear off during use.

BRIEF SUMMARY OF THE INVENTION

It is the concept of the present invention to provide each loop of saw chain with a special link that can be readily identified and which has the replacement information stamped or embedded into the material. All other parts of the chain can be mass produced as before. The special link will be stamped, i.e., the information etched into the material in a manner that will not wear away. Whereas the information may be difficult to read without cleaning the surface area whereat the number is applied, the link itself will be readily identifiable. In a preferred embodiment, the link is a tie strap that is coated with a zinc finish that is noticeably different in appearance than the other links of the chain. Other distinguishing characteristics are, however, possible. Other finishes or even a modified link configuration will enable the user to identify the link, and cleaning the surface of that link will expose the information and enable the user to read the information.

The information preferably is a letter and/or number code, e.g., having three digits. The user simply goes to a store that sells saw chain (point of sale) and a chart provided at the store (a separate chart or the chain packaging) will enable the user to easily locate the correct replacement chain.

The invention will be more fully appreciated and understood with reference to the following detailed description and accompanying drawings.

BRIEF DESCRIPTION OF THE DRAWINGS

FIG. 6 illustrates a chart that may be used at the point of sale to identify specific chain loop.

DESCRIPTION OF THE PREFERRED EMBODIMENT

Figure 1:
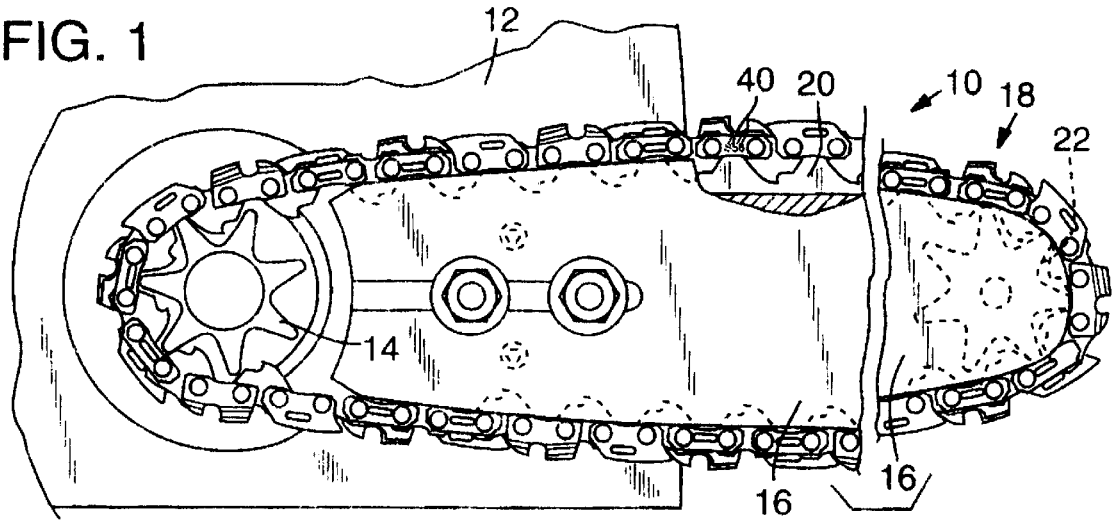
FIG. 1 is a view of a portion of a chain saw.

FIG. 1 illustrates a portion of a chain saw 10. The chain saw 10 is of the type that is utilized most often in the felling of trees, sawing felled trees into lengths, pruning limbs from a tree and other varied uses involving sawing wood products. The chain saw 10 has a housing 12 which houses a drive motor and the drive motor is arranged to drive a drive sprocket 14. Removably mounted to the housing 12 and strategic to the drive sprocket 14 is a guide bar 16 that has a guide groove 20. Some guide bars 16 have a nose sprocket 22 mounted at the nose end. A saw chain 18 in the form of an endless loop is entrained around the drive sprocket 14 and the guide bar 16.

It will be appreciated that the chain saw 10 will come in various sizes having different sized drive motors and lengths of bars 16. Typically a chain saw 10 having a certain sized drive motor fitted in the housing 12 may have different lengths of bars 16 that are mounted to the housing 12. The saw chain 18 thus must be matched not only to the drive sprocket 14 and the guide groove 20 and the nose sprocket 22 of the guide bar 16 but also must be of the correct length.

Referring now to FIGS. 2–5, the saw chain 18 typically is of the type that has center drive links 30 that are pivotally interconnected to front and rear parts of side links by rivets 34. Certain of the side links of the pairs of side links are right and left hand cutter links 32. Opposite each cutter link is a tie strap 36. The specific chain illustrated is a standard sequence chain where alternating parts of side links are a cutter link and tie strap pair seperated by a tie strap pair. As shown one of the tie straps of the tie strap pairs may be configured to have guard portions 38 sometimes referred to as a guard tie strap. Such guard portions are not always provided and saw chains of the type herein contemplated are subject to numerous variations.

The specification for the saw chain 18 will vary depending on the size of the chain saw 10, the length of the guide bar 16, the configuration of the drive sprocket 14 and, if provided, the nose sprocket 22 of the guide bar 16. It is thus essential that a user when replacing the saw chain 18 obtain a saw chain that has the proper specifications and further that the saw chain 18 will have the prescribed length.

The saw chain of the present invention is coded so that a user may readily obtain a replacement chain. In this embodiment the saw chain has an identification code stamped (imprinted) on one of the tie straps. Because there are many tie straps in a loop of saw chain and because they are all similarly coated with dirt and grime, the code carrying tie strap is made distinguishable from the rest of the tie straps utilized in the saw chain 18.

Figure 2:
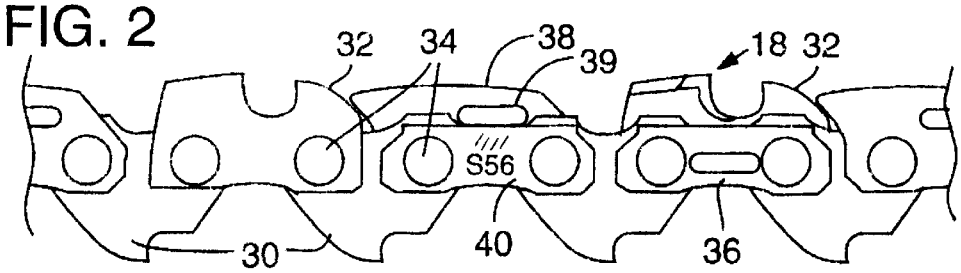
FIGS. 2–5 are views illustrating a portion of the saw chain utilized on the chain saw of FIG. 1.

Referring to FIG. 2, a tie strap 36 designated as 40 to distinguish it from the other tie straps has the letter S and the number 56 stamped into the side of the tie strap 40. Further, the tie strap 40 is of a different color than the balance of the tie straps 36. The tie strap 40 in FIG. 2 is shaded to indicate that it is of different color than the other tie straps 36 of the saw chain 18. Painting of the tie strap 40 generally is not sufficient since the paint will be worn off during use of the saw chain 18. One manner of providing the tie strap 40 with a distinguishing color from the balance of the tie straps 36 is to coat the tie strap 40, e.g., with a durable material, e.g., a zinc plating.

When it is necessary to replace the saw chain, a user will locate the tie strap 40 on the old chain by the color distinction. The dirt and grime will be wiped away to expose the code. In this embodiment the stamped letter and number (S56) on the tie strap 40 provides the information to select a replacement chain. Typically a vendor has a sales chart listing the different types of chain and from this the user will be able to select the proper replacement chain. The packaging of the chain may also have the code imprinted thereon as an alternative to the chart.

Figure 3:
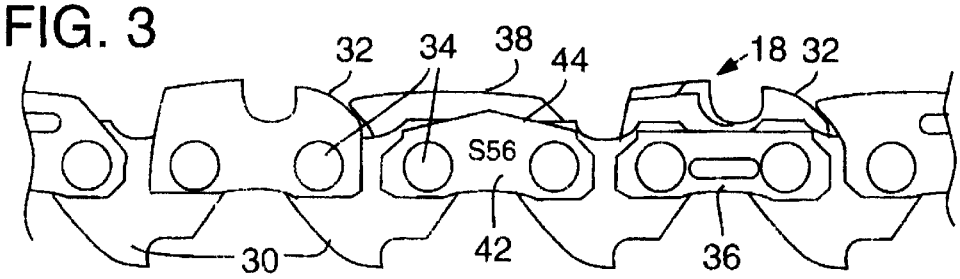

FIG. 3 illustrates another tie strap 42 that also has the letter S and the number 56 stamped into the side of the tie strap 42. Further the tie strap 42 has a different shape than the balance of the tie straps 36. The different shape of the tie strap 42 will distinguish the tie strap 42 from the others in the saw chain 18. As seen in FIG. 3, the tie strap 42 has a triangular peak 44. A user when replacing the saw chain 18 will simply look for the configuration of the tie strap 42 and from the imprinted information will be able to select the correct replacement saw chain for the chain saw 10.

Figure 4:
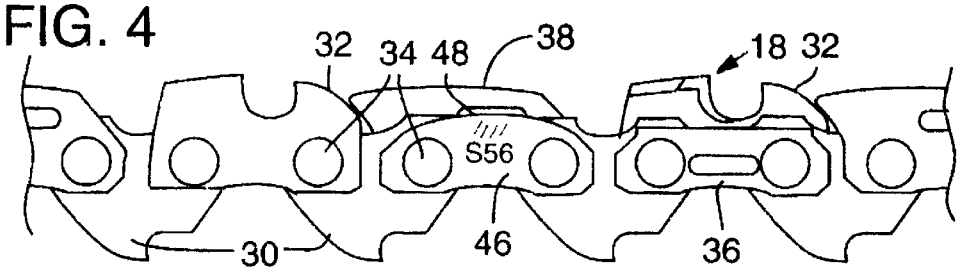
Figure 5:
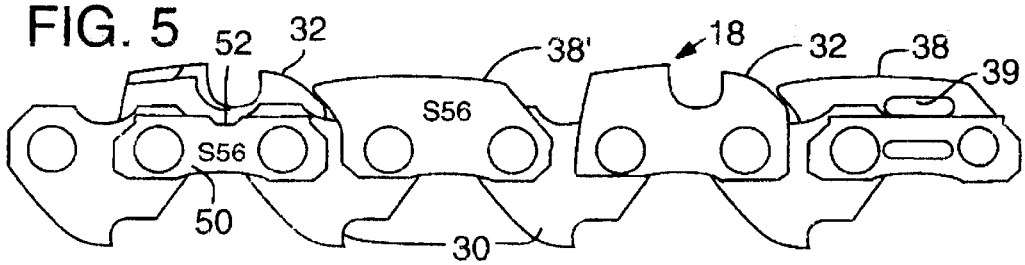

FIGS. 4 and 5 illustrate other variations of tie straps 46 and 50 with the tie strap 46 having an arcuate hump 48 and the tie strap 50 having a distinguishing notch 52. The tie straps 46, 50 have the letter S and the number 56 stamped on their sides. Each tie strap 46 and 50 is different in shape and a user will be able to rapidly find the specification of the saw chain.

Other variations are contemplated for identifying the saw chain. One example is to utilize one of the guard tie strap links 38. The guard tie straps 38 in this embodiment have an aperture 39 in their upstanding guard portions. One of the guard tie straps 38' illustrated in FIG. 5 does not have the aperture 39 and therefore may be rapidly found on the saw chain 18. The side of the link 38' without the aperture 39 has the letter S and the number 56 stamped on its side to provide the identifying specification of the saw chain 18.

FIG. 6 is a chart that enables a user to match up the code on his saw chain with more specific information, i.e., that will enable him to select the desired chain loop. The display of chain loops may also provide a form of chart but such requires that all of the different saw chain types are available at the point of sale.

Those skilled in the art will recognize that modifications and variations may be made without departing from the true spirit and scope of the invention. The invention is therefore not to be limited to the embodiments described and illustrated but is to be determined from the appended claims.

I claim:

1. A saw chain comprising:

a series of multiple center links and side links, said side links including tie straps and cutter links, all arranged in a repetitive sequence and pivotally interconnected to form a loop of saw chain;

at least one link in the sequence of links provided with an identifying feature that causes that link to visually stand out from other links performing a similar function in the saw chain, said feature provided such as to enable that link to be identified by a user regardless of wear to the saw chain; and said one link additionally provided with printed information identifying the chain characteristics for replacement purposes, which information is embedded into the surface of the link enabling a user to read the information and from the information enable the selection of a replacement saw chain loop.

2. A saw chain as defined in claim 1 wherein said one link is provided with a wear resistant coating that provides that link with a different appearance.

3. A saw chain as defined in claim 1 wherein said one link is configured to have a different profile as compared to similar links in the chain link sequence in which the different profile is readily apparent to a user.

4. A method of identifying characteristics of a loop of saw chain to enable a user to replace a used loop of saw chain with a similar loop of saw chain, said method implemented during production of the saw chain loop, comprising:

selecting a specific link of a sequence of links to be formed into a loop of saw chain;

providing a replacement link that is different in appearance from the appearance of the selected link and readily recognizable by a user because of that difference;

embedding the replacement link with printed information, providing a point of sales chart containing the information and enabling the user to select a similar replacement loop of chain from among non-similar loops of chain; and replacing said specific link in said sequence of links with said replacement link and forming a loop of saw chain therefrom to enable a user to readily identify the information bearing replacement and thereby readily discern the information needed for replacement of the loop of saw chain.

* * * * *